US005906533A

United States Patent [19]

Harris et al.

[11] Patent Number: 5,906,533

[45] Date of Patent: May 25, 1999

[54] RADIANT POLISHING BLOCK HEATER

[75] Inventors: Darrel M. Harris, Kirkwood, Mo.; Harold E. Hall, Jr., Rougemont, N.C.

[73] Assignee: MEMC Electronic Materials, Inc., St. Peters, Mo.

[21] Appl. No.: 08/950,842

[22] Filed: Oct. 15, 1997

Related U.S. Application Data

[63] Continuation of application No. 08/656,097, May 31, 1996, abandoned.

[51] Int. Cl.[6] ..... B24B 1/00

[52] U.S. Cl. ..... 451/41; 451/460; 451/7; 451/285

[58] Field of Search ..... 451/5, 6, 7, 9

[56] References Cited

U.S. PATENT DOCUMENTS 4,450,652 5/1984 Walsh ..... 451/7
5,127,196 7/1992 Morimoto et al. ..... 451/7
5,597,442 1/1997 Chen et al. ..... 451/7
5,605,487 2/1997 Hileman et al. ..... 451/41

*Primary Examiner*—Robert A. Rose
*Assistant Examiner*—George Nguyen
*Attorney, Agent, or Firm*—Senniger, Powers, Leavitt & Roedel

[57] ABSTRACT

A method for mounting a semiconductor wafer on a polishing block to hold the semiconductor wafer during polishing. The method comprises the steps of providing a polishing block having a surface for mounting the semiconductor wafer, coating the polishing block surface with a bonding agent, applying radiant heat to the polishing block and bonding agent to soften the bonding agent, and applying the semiconductor wafer to the softened bonding agent. The step of applying radiant heat to the polishing block and bonding agent is performed by a radiant heater in a dry environment.

17 Claims, 9 Drawing Sheets

RADIANT POLISHING BLOCK HEATER

This is a continuation of application Ser. No. 08/656,097, filed May 31, 1996 abandoned.

BACKGROUND OF THE INVENTION

This invention relates generally to a method and apparatus for mounting a semiconductor wafer on a polishing block to hold the wafer during polishing. More particularly, the invention relates to an infrared heater for heating the polishing block to soften a bonding agent applied to the block so that the wafer may be temporarily bonded to the block.

The faces of semiconductor wafers are polished during manufacture to provide very smooth finish and surface flatness. Semiconductor wafers must be polished so they are extremely flat and smooth before printing electronic circuits on them by electron beam lithography or photolithography. Flatness is critical to maintain resolution of the printed lines which can be as narrow as one micron or less. However, because the wafers are thin, they may flex during the polishing operation if they are not rigidly supported over their entire areas, or the necessary surface flatness and finish may not be achieved. Thus, it is important that the wafers are supported over their entire areas during polishing.

To prepare the wafers for polishing, they are mounted on flat polishing blocks using a bonding agent or wax which firmly grips and rigidly supports the wafers. The bonding agent is applied in a thin coat to one face of the polishing block, and the block and agent are heated so that the agent dries and softens. The wafer is pressed against the softened agent, and, as the agent cools, it firmly grips the wafer so that the wafer cannot easily be pulled or sheared off the block during the polishing operation. Further, the agent stiffens as it cools so that it rigidly supports the wafer during the polishing operation and the needed surface flatnesses and finishes may be obtained.

In the past, an apparatus known as a steam pot was used to heat polishing blocks coated with bonding agents. As its name implies, a steam pot is a vessel containing boiling water. To heat the block, it is seated in an opening at the top of the steam pot so that the side of the block opposite the bonding agent is exposed to the steam inside the vessel. The steam heats the block by convection and conduction heat transfer. The block conducts the heat from its side exposed to the steam to the side to which the bonding agent is applied, thereby drying and softening the bonding agent. However, because the block is cooler than the steam, water condenses on the side exposed to the steam. Although the side of the block having the bonding agent does not face the interior of the steam pot, water will occasionally come in contact with the bonding agent. When water contacts the bonding agent, it becomes pitted which causes small, localized portions of the wafer to be inadequately gripped and supported. As a result, when the polishing block is heated with a steam pot and water condenses or splatters on the block, it must be dried before further processing to avoid water contact with the bonding agent.

Most previously used bonding agents contained trichlorethylene as a solvent. However, because trichlorethylene has been identified as possibly adversely impacting the environment, other bonding agents which do not contain trichlorethylene have been introduced. For instance, water-based bonding agents have been developed. However, these "green" water-based bonding agents do not perform well when heated in steam pots because they are highly water dispersible. Thus, when water droplets come in contact with the agents, large voids occur and the wafers are not adequately supported or gripped.

In an attempt to reduce water splatter, the amount of power delivered to the steam pots has been reduced, but this reduced the steam production which increased the time it took to sufficiently heat the blocks. Longer heating times are undesirable because they increase production time and costs. To speed up production, softer bonding agents have been used so that the blocks did not need to be heated to as high a temperature Thus, lower power settings and shorter heating times could be used. However, the softer agents are stickier, thereby preventing the wafers from being easily released after polishing and substantially offsetting savings in production achieved using the softer bonding agent.

SUMMARY OF THE INVENTION

Among the several objects of this invention may be noted the provision of a method and apparatus capable of heating the polishing blocks to quickly and inexpensively dry and soften the bonding agents; the provision of such a method and apparatus in which water-based bonding agents may be used without adversely affecting semiconductor flatness or surface finish; and the provision of such a method and apparatus in which the polishing blocks, semiconductor wafers and bonding agents do not come in contact with water.

The method of this invention is used to mount a semiconductor wafer on a polishing block to hold the semiconductor wafer during polishing. Generally, the method comprises the steps of providing a polishing block having a surface for mounting the semiconductor wafer, coating the polishing block surface with a bonding agent, applying radiant heat to the polishing block and bonding agent to soften the bonding agent, and applying the semiconductor wafer to the softened bonding agent. The step of applying radiant heat to the polishing block and bonding agent is performed by a radiant heater in a dry environment.

In another aspect, the invention is an apparatus for performing the previously described step of applying radiant heat to the polishing block and bonding agent to soften the bonding agent. Generally, the apparatus comprises a polishing block holder constructed to receive and hold a polishing block and a radiant heater for directing radiant thermal energy toward the polishing block received and held by the polishing block holder to heat the polishing block.

In yet another aspect of the invention, a semiconductor mounting system comprises a bonding agent applicator, a radiant heater, a mounting apparatus, and a controller. The bonding agent applicator applies a releasable bonding agent to a surface of a polishing block. The radiant heater directs radiant thermal energy toward the polishing block coated with the bonding agent to heat the polishing block and bonding agent. The mounting apparatus mounts a face of a semiconductor wafer to the polishing block surface. The controller controls operation of the bonding agent applicator, the radiant heater, and the mounting apparatus.

Other objects and features of this invention will be in part apparent and in part pointed out hereinafter.

BRIEF DESCRIPTION OF THE DRAWINGS

Corresponding parts are designated by corresponding reference characters throughout the several views of the drawings.

DETAILED DESCRIPTION OF THE PREFERRED EMBODIMENT

Figure 1:
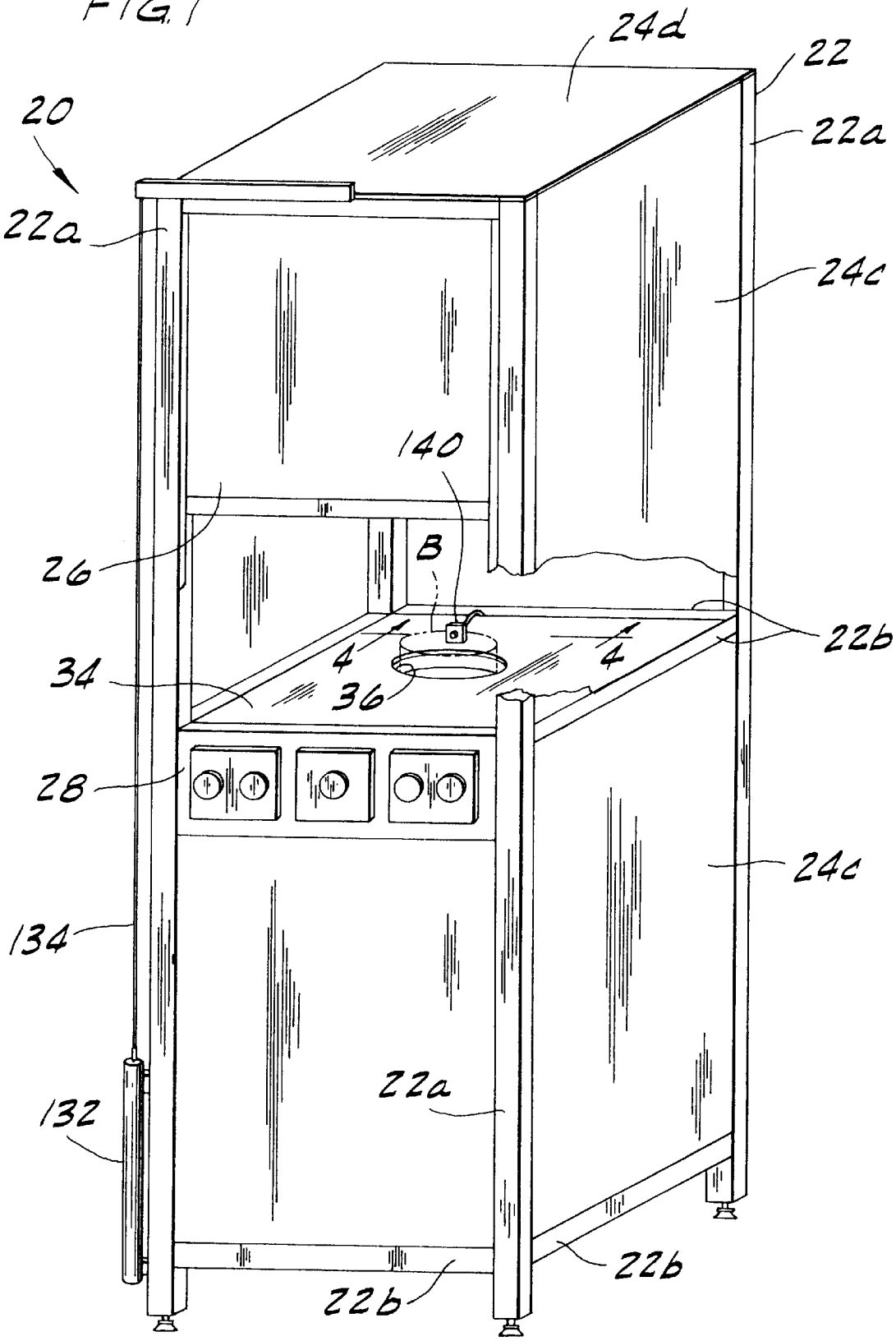
FIG. 1 is a front and right side perspective of a radiant polishing block heater of the present invention.
Figure 2:
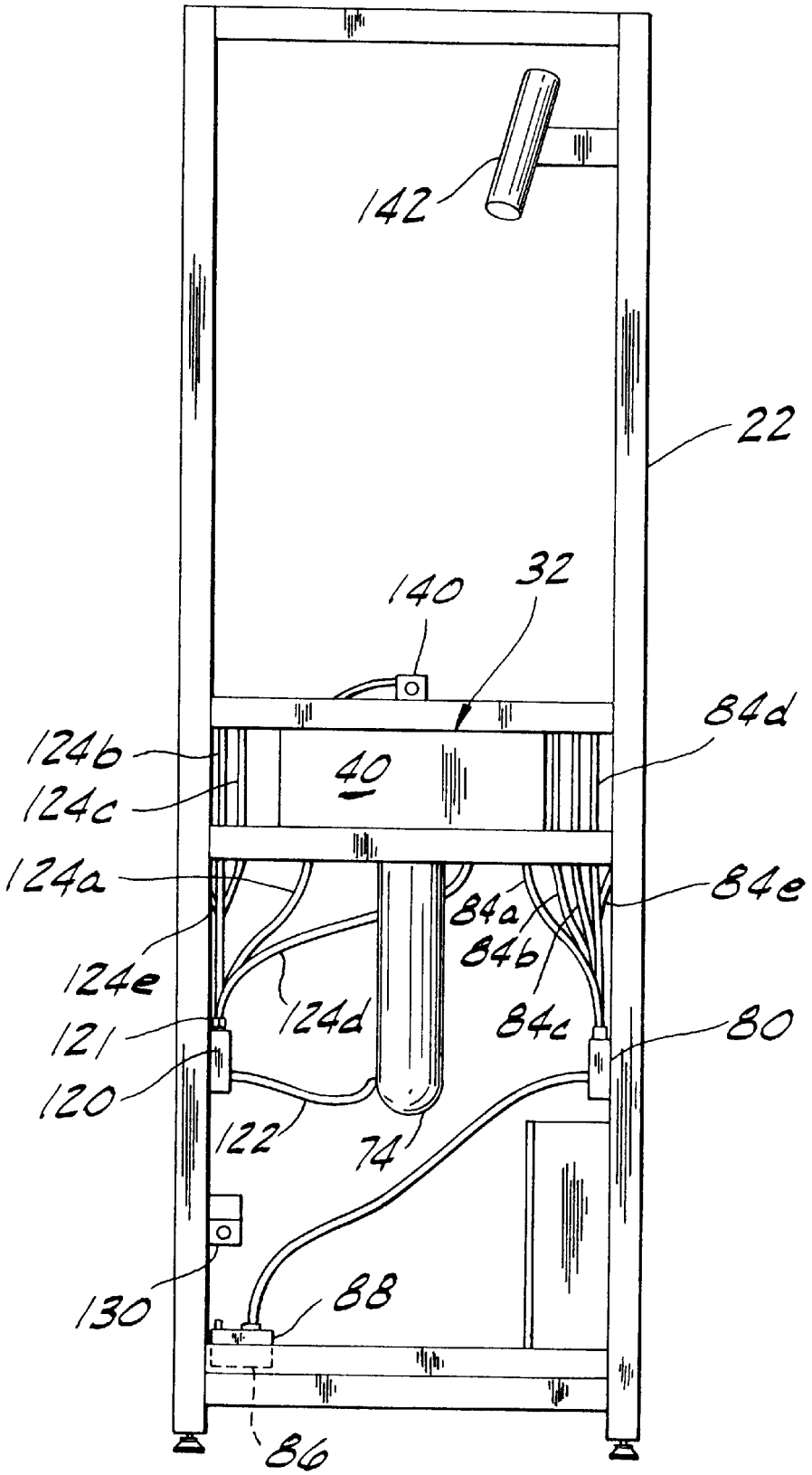
FIG. 2 is a front elevation of the polishing block heater with panels removed to show internal construction.
Figure 3:
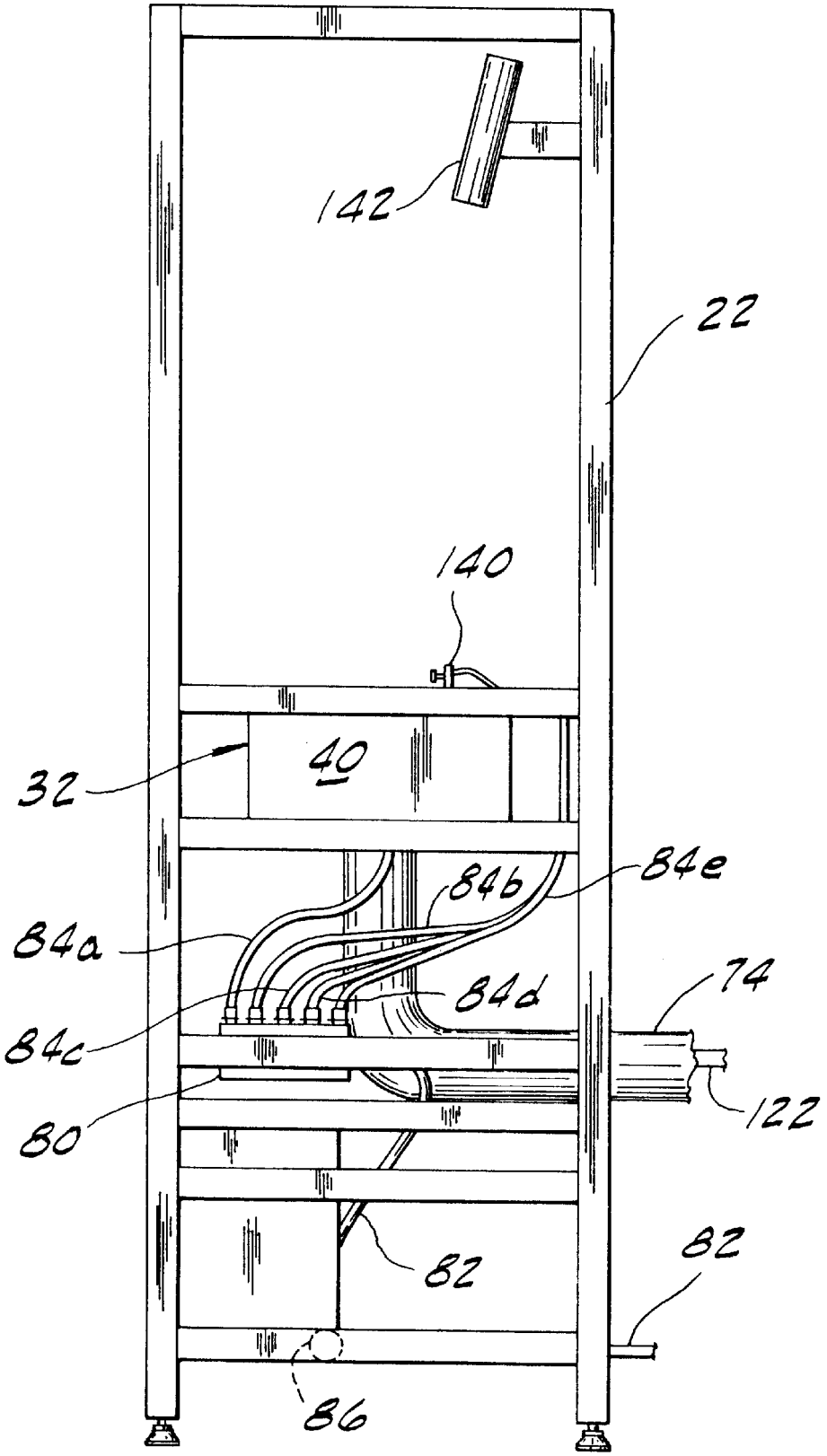
FIG. 3 is a right side elevation of the polishing block heater of FIG. 2.

Referring now to the drawings, and first more particularly to FIG. 1, the apparatus of a first preferred embodiment for heating polishing blocks is indicated in its entirety by the reference numeral 20. The apparatus 20 supported by a frame 22 having upright members 22*a* and cross members 22*b*. The frame supports front panel 24*a*, rear panel 24*b*, side panels 24*c*, top panel 24*d*, and a sliding door 26 which may be opened to insert and remove polishing blocks B from the apparatus. A control panel 28 mounts instrumentation for monitoring and controlling the operation of the apparatus. The apparatus 20 comprises a polishing block holder, generally designated by 30 (FIG. 6), and a infrared heater, generally designated by 32 (FIGS. 2 and 3). The holder 30 and heater 32 are positioned below a table 34 having a opening 36 sized to accept the polishing block B. As will be explained in greater detail below, the holder 30 of the first embodiment is formed by lobes of cooling water pipes which extend into the opening 36 below the table 34.

FIGS. 2 and 3 show the apparatus with the panels 24*a*–24*d*, sliding door 26 and control panel 28 removed from the frame 22 so the internal components, such as the heater 32, are visible. The internal structure of the infrared heater 32 is more apparent by reference to FIGS. 8–10. The heater includes a housing 40 which houses three side-by-side infrared lamp units, generally designated by 42. Each lamp unit 42 includes a body 44 and four insulators 46 which space the body above the bottom of the housing 40 to electrically insulate the lamp unit from the housing. Positioned adjacent the ends of each body 44 are five hollow supports 50 which support tubular infrared emitters or lamps 52 adjacent reflector grooves 54 (FIG. 9) formed in the upper surface of the bodies.

The lamps units 42 are positioned so the lamps 52 extend front to back in the housing 40 generally under the holder 30. Five lamps 52 are mounted on the supports 50 of the middle lamp unit 42, but only three lamps are mounted on the other units. The three lamps 52 are positioned on the supports 50 closest to the holder 30 as lamps spaced farther away from the holder would not effectively heat a block B held in the holder. Each lamp 52 includes wire leads 54 extending from its ends and downward through the hollow supports 50 to a common bus 56 mounted adjacent the bottoms of the supports. The buses 56 are connected to an external power supply (not shown) which is controlled by a programmable logic controller 58*b* (FIG. 12) positioned external to the apparatus. Each of the lamps 52 are supplied with 60 amps of electrical current at 480 volts to produce 6 kilowatts of power. In the most preferred embodiment, each of the lamp units 42 is a model 5090-10-01 high density infrared heating component made by Research Inc. of Minneapolis, Minn., and the lamps 52 are Q6MT3/CL/HT quartz infrared emitters made by Research Inc.; however, it is envisioned that other types of radiant heater lamp units and lamps may be used without departing from the scope of this invention.

Figure 8:
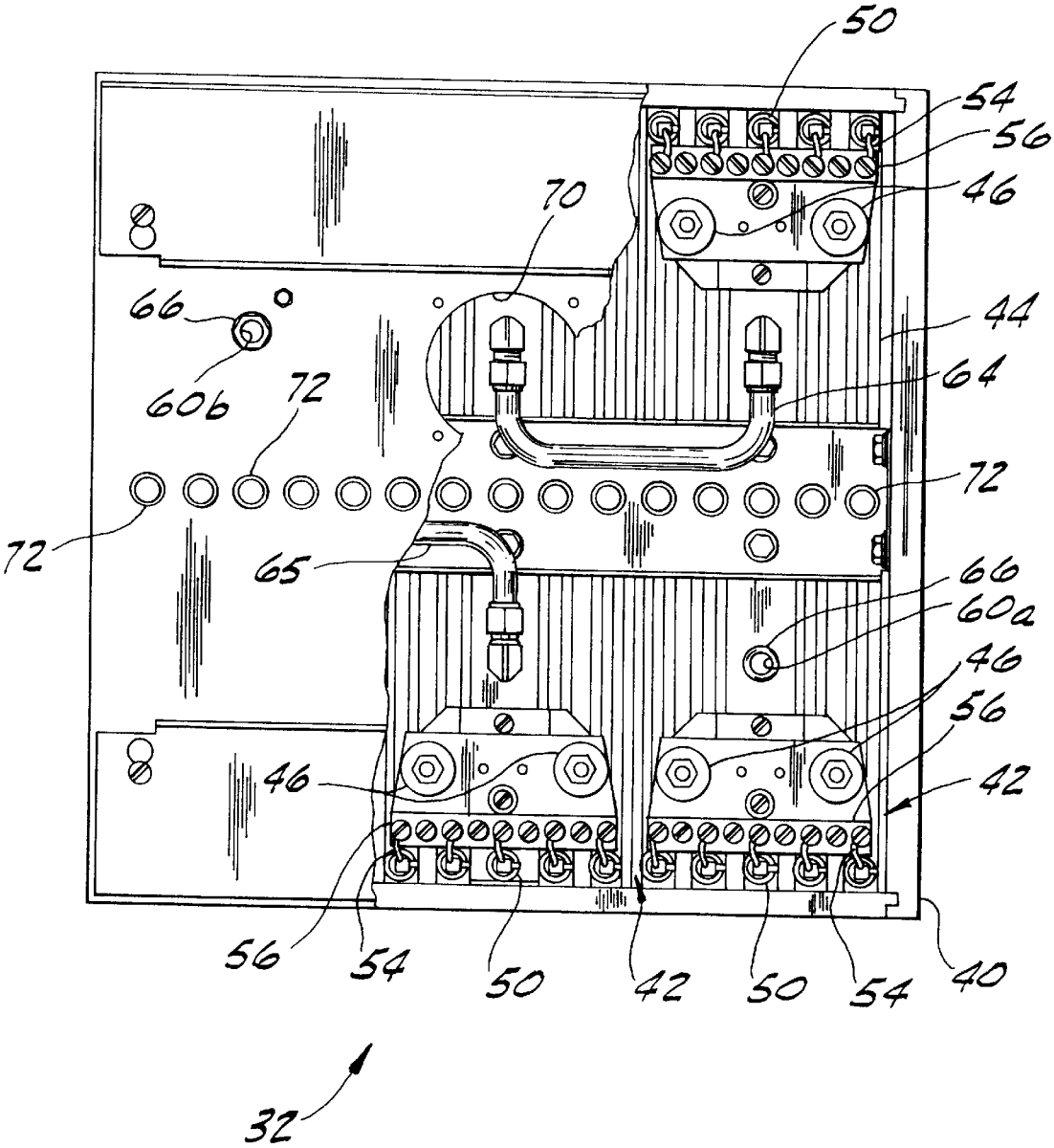
FIG. 8 is a fragmentary bottom plan of the infrared heater of the present invention.
Figure 9:
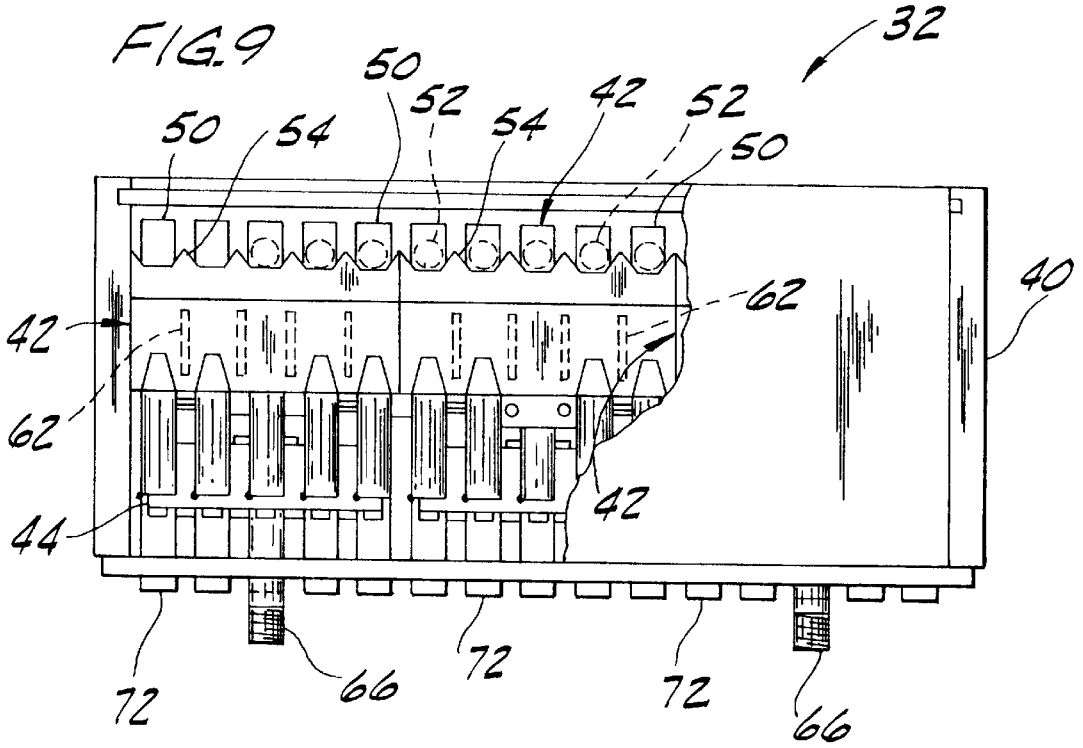
FIG. 9 is a fragmentary front elevation of the infrared heater.
Figure 10:
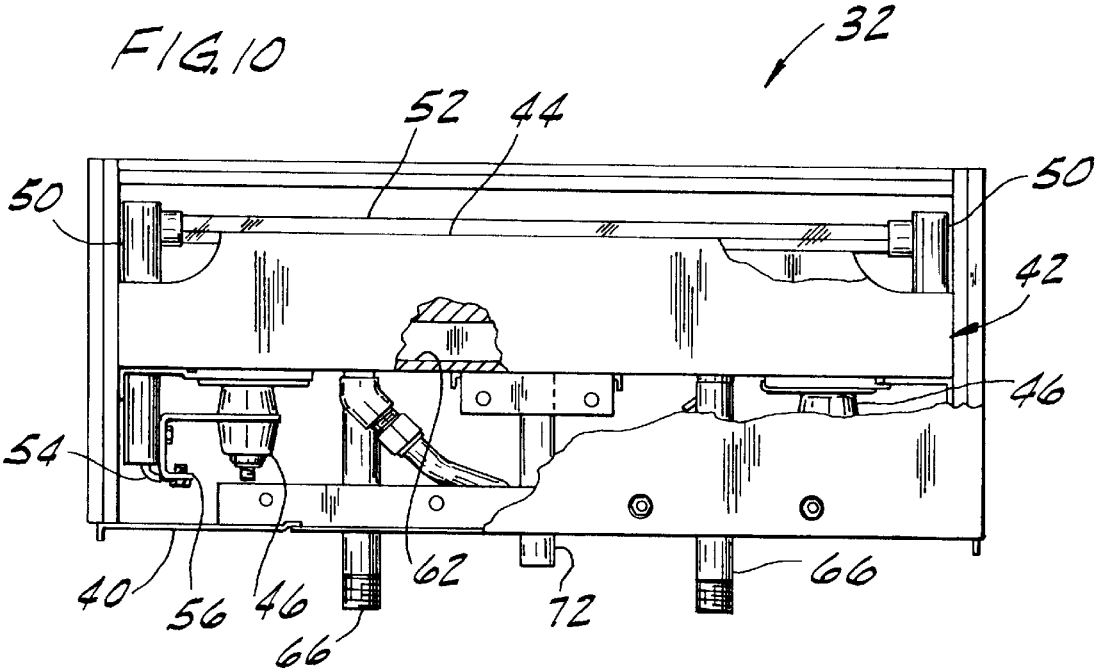
FIG. 10 is a fragmentary right side elevation of the infrared heater.

Each body 44 has two threaded ports 60 (FIG. 8) on its lower side. As shown in FIGS. 9 and 10, each body 44 has interconnected cooling passages 62 which extend through the body from one port to the other. Cooling water is delivered to the rearward port of the right unit 42 as shown in FIG. 8. The cooling water delivered to the rearward port 60*a* of the right unit 42 travels through the passages 62 of the right unit and exits through the forward port of the unit where it travels through a tube 64 to the forward port of the middle unit. Similarly, the water travels through the middle unit and exits through the rearward port before traveling through a second tube 65 connecting the rearward ports of the middle and left units. The water travels through the left unit and exits through the forward port 60*b*. Thus, water entering the first unit is transferred to the second unit and from the second unit to the third unit. Short nipples 66 (see also FIG. 9) extend through the housing 40 from the forward left and rearward right ports 60*a*, 60*b* for connecting them to the cooling water circuit.

Air is drawn into the housing 40 through two holes 70 (only one of which is partially shown in FIG. 8) in the bottom of the housing. The air travels between the units 42 and the housing bottom to the hollow lamp supports 50 adjacent the ends of the units. The air travels upward through the supports 50 and toward the center of each unit 42 where a set of tubes 72 positioned midway along each of the units permits the air to travel downward through the tubes 72 into a plenum (not shown) attached to the bottom of the housing 40. Returning to FIGS. 2 and 3, an exhaust tube 74 vents hot air from the plenum to a facility exhaust (not shown) positioned outside the apparatus 20. The facility exhaust includes a blower for drawing air through the housing 40 and out the exhaust tube 74 to cool the heater 32. A flow sensor (not shown) is positioned along the exhaust tube 74 for measuring the air flow drawn through the tube so that the heater 32 may be de-energized in the event of inadequate cooling flow as will be explained in greater detail below.

A cooling system for the table 34 and holder 30 is shown to include a cooling water manifold 80 mounted on the right side of the frame 22 for distributing cooling water from a supply line 82 (FIG. 3) connected to the rearward end of the manifold to five flexible cooling water lines 84*a*–84*e* connected to the top of the manifold. The supply line 82 is connected to an external cooling water source (not shown) for supplying the manifold 80 with cooling water. A solenoid valve 86 and flow sensor 88 are positioned along the supply line 82 for controlling and monitoring the flow of water to the heater 32 and other cooling passages. Line 84*a* extends to the nipple 66 associated with the rearward right port 60 shown in FIG. 8 for delivering cooling water to the lamp unit cooling passages 62.

Figure 4:
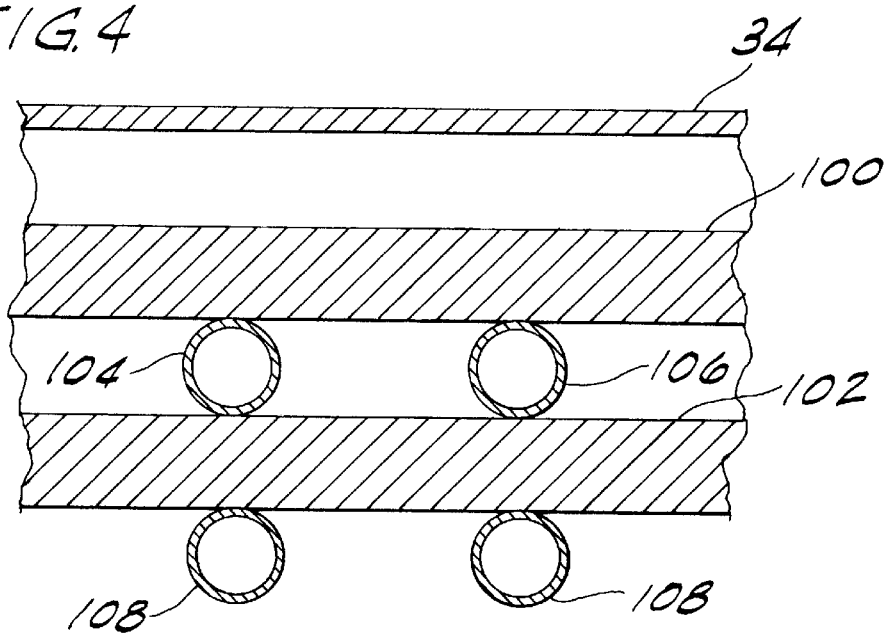
FIG. 4. is a fragmentary, schematic cross section of the cooling water passages taken in the plane of line 4—4 of FIG. 1.
Figure 5:
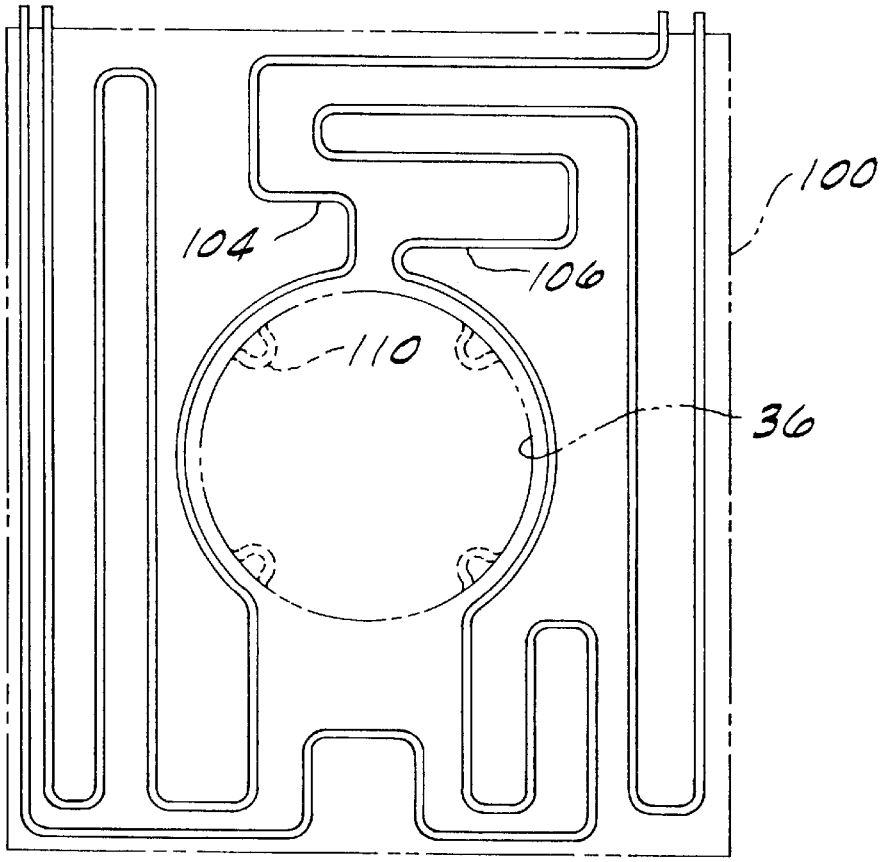
FIG. 5 is a schematic top plan view of an upper cooling water passage.
Figure 6:
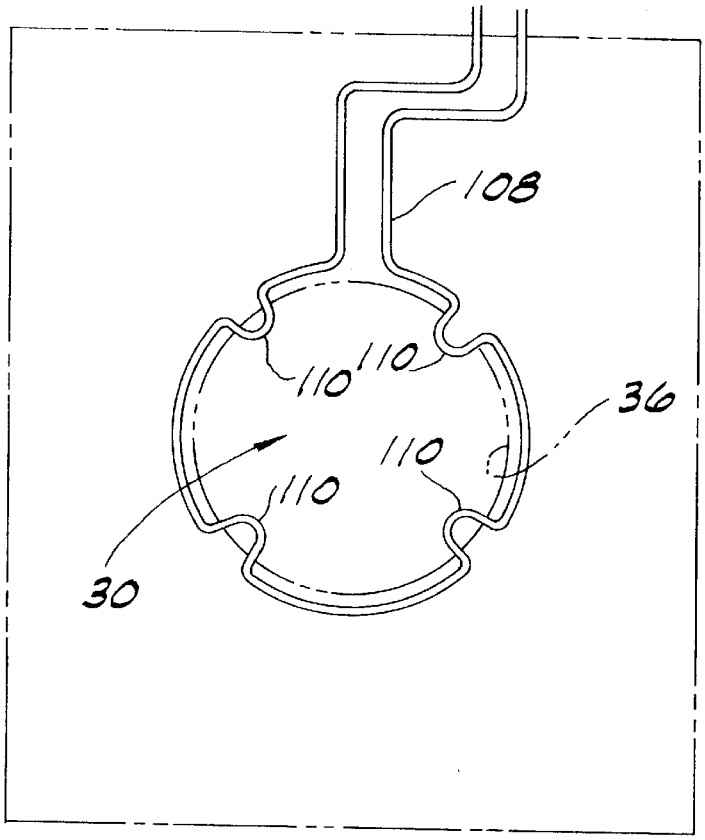
FIG. 6 is a schematic top plan view of a lower cooling water passage.

Lines 84*b*–84*d* extend to upper and lower cooling plates 100, 102 (FIG. 4) positioned below the table 34. As shown in FIG. 4, the table 34 consists of a 1/16 inch thick sheet of stainless steel. Two ¼ inch thick aluminum plates form the cooling plates 100, 102 positioned below the table 34 at ¼ inch intervals. As shown in FIGS. 5 and 6, two lengths of copper tubing 104, 106 are positioned between the upper and lower cooling plates 100, 102 and a length of stainless steel tubing 108 is positioned below the lower cooling plate. The lengths of tubing 104, 106 are formed as serpentine cooling passages to cool the table 34. Lines 84*b* and 84*c* (FIGS. 2 & 3) extend from the manifold 80 to deliver cooling water to the tubing lengths 104, 106, respectively. As shown in FIG. 6, the stainless steel tubing length 108 is formed with lobes 110 that protrude inward into the table opening 36. Together, the lobes 110 form the block holder 30 of the first embodiment. Line 84*d* (FIGS. 2 & 3) extending from the manifold 80 is connected to the stainless steel tubing length 108 to deliver water to the holder 30 to cool it.

Figure 7:
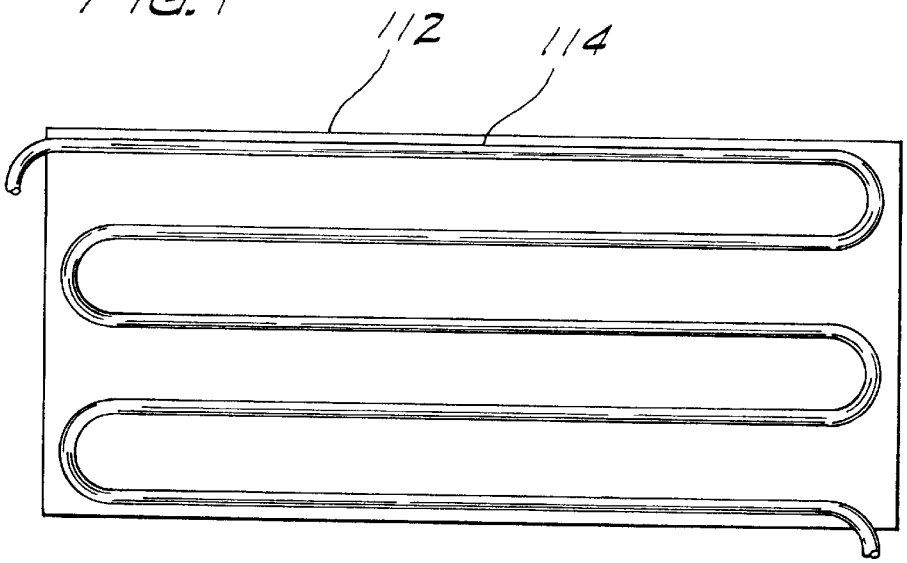
FIG. 7 is a schematic right side elevation of a cooling water passage adjacent the right side of an infrared heater.

FIG. 7 illustrates one of four plates 112 and tubes 114 which are mounted on the frame 22 around the heater 32, one adjacent each side of the housing 40. These plates 112 were removed in FIGS. 2. and 3 for clarity. Cooling water is delivered to the tube 114 through line 84*e*. The tube 114 has a serpentine configuration to promote heat transfer from the plate 112 to the cooling water traveling through the tube 114. After traveling along one side of the apparatus 20, the water travels to similar tubes and plates on adjacent sides of the apparatus until the water travels around all four sides.

Returning again to FIGS. 2 and 3, positioned on the left side of the frame 22 is a cooling water return manifold 120 similar to manifold 80. The return manifold 120 directs cooling water from five inlet ports 121 (only one of which is shown in FIG. 2) on the top of the manifold to an outlet port (not shown) on the rearward end of the manifold. A drain line 122 is connected between the outlet port of the manifold 120 and an external facility drain (not shown). Five flexible cooling water output lines 124*a*–124*e* are connected to respective manifold inlet ports 121. Line 124*a* extends from the nipple 66 associated with the forward left port 60 of the heater 32 shown in FIG. 8 to deliver used cooling water to the facility drain. Lines 124*b*–124*e* are connected to the downstream ends of the lengths of tubing 104, 106, 108 and 114 respectively, to drain spent cooling water from those passages.

Figure 12:
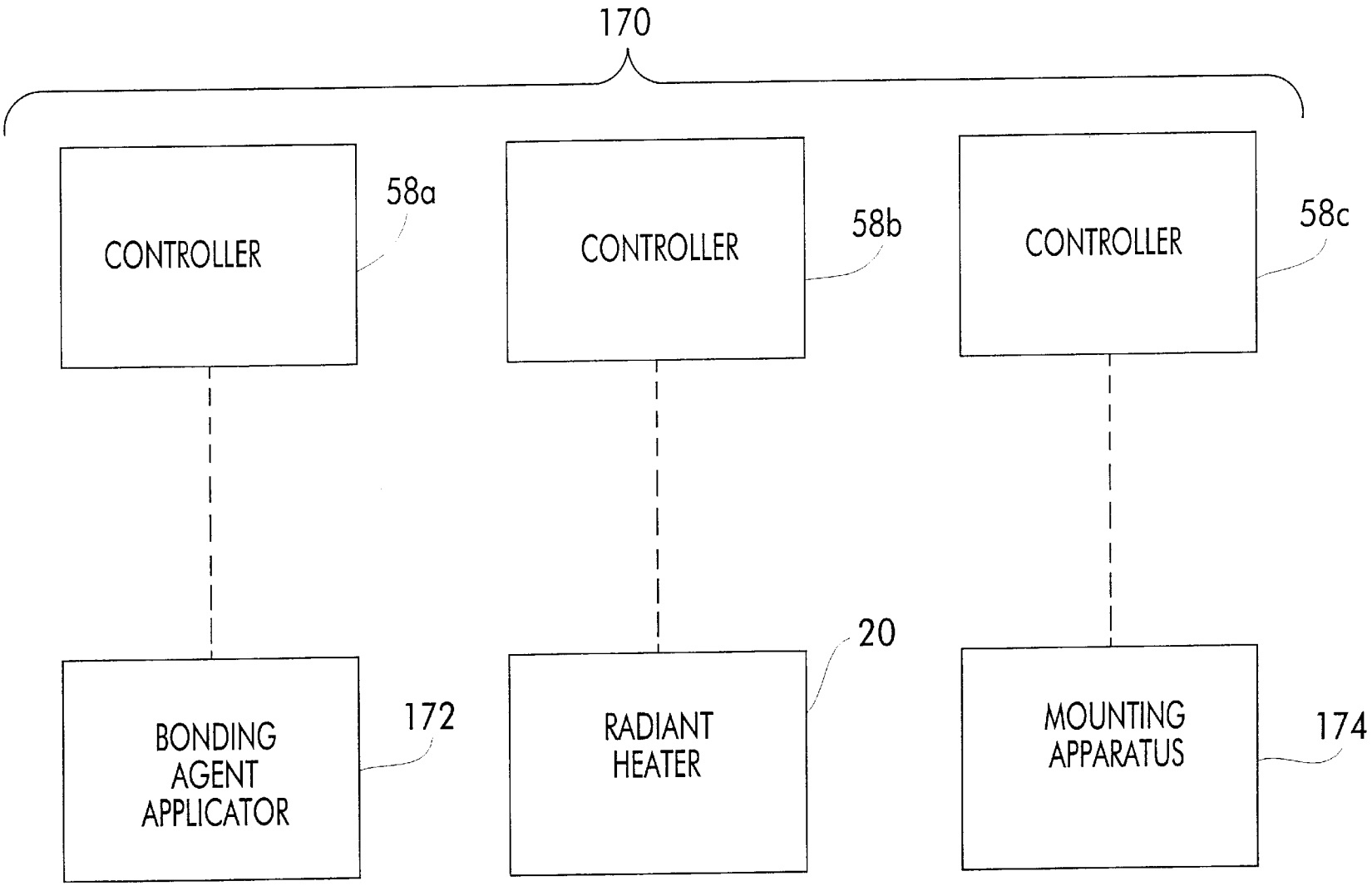
FIG. 12 is a block diagram showing a semiconductor mounting system of the present invention.

A second solenoid valve 130 positioned above the first solenoid valve 86 opens and closes the door 26 (FIG. 1) in response to a signal from the controller 58*b* (FIG. 12). Valve 130 is connected to a linear actuator 132 (FIG. 1) to supply the actuator with air to force its piston downward. The piston is connected to a wire 134 (FIG. 1) which is connected to the sliding door 26 (FIG. 1) so that the door is raised when air is delivered to the actuator 132.

As shown in FIGS. 1–3, a proximity switch 140 is mounted on the table 34 adjacent the polishing block holder 30 to sense when polishing blocks B are present in the holder. The switch 140 is connected to the programmable logic controller 58*b* (FIG. 12). An optical pyrometer 142 (FIGS. 2 & 3) is mounted near the top of the apparatus 20 and is aimed toward the holder 30 to detect the temperature of the top of a polishing block B held within the holder. The pyrometer 142 is also connected to the programmable logic controller.

In operation, the door 26 is raised and a polishing block B having a bonding agent coating applied to its upper surface is placed on the holder 30. The door 26 is closed and the lamp units 42 are energized to direct infrared radiant thermal energy upward from the heater 32 toward the bottom surface of the block B. When a predetermined temperature sufficient to soften the bonding agent is sensed by the pyrometer 142, the lamp units 42 are de-energized, the door 26 is raised and the block B is removed from the holder 30. Although other temperatures are also within the scope of this invention, it has been found that de-energizing the lamp units 42 when the pyrometer 142 senses a temperature of 75° C. works well because the temperature of the top of the block and the bonding agent continue to rise after the lamp units are de-energized due to continued transfer of heat to the top of the block caused by the high thermal gradient through the block. If the lamp units 42 are de-energized when the top of the block reaches 75° C., the top of the block and bonding agent will reach 95–100° C. by the time the wafer is applied (approximately 30–35 seconds after the lamp units 42 are de-energized). A radial hole (not shown) in the side of the block B permits the insertion of a handle for transporting the heated block.

The programmable logic controller 58*b* (FIG. 12) is programmed so that the lamp units 42 are not energized if insufficient cooling water or air flow is sensed by the flow sensors along the water and air passages. Further, if the proximity switch 142 does not sense the presence of a block B in the holder 30, the lamp units 42 will not be energized. A sensor (not shown) is also connected to the door 26 to sense whether it is entirely closed. If the door 26 is even partially open, the controller 58*b* will not energize the lamp units 42. The controller 58*b* will also turn the cooling water off by closing the solenoid valve 86 if the lamp units 42 have been inactive for a predetermined period of time, e.g. 15 minutes.

Figure 11:
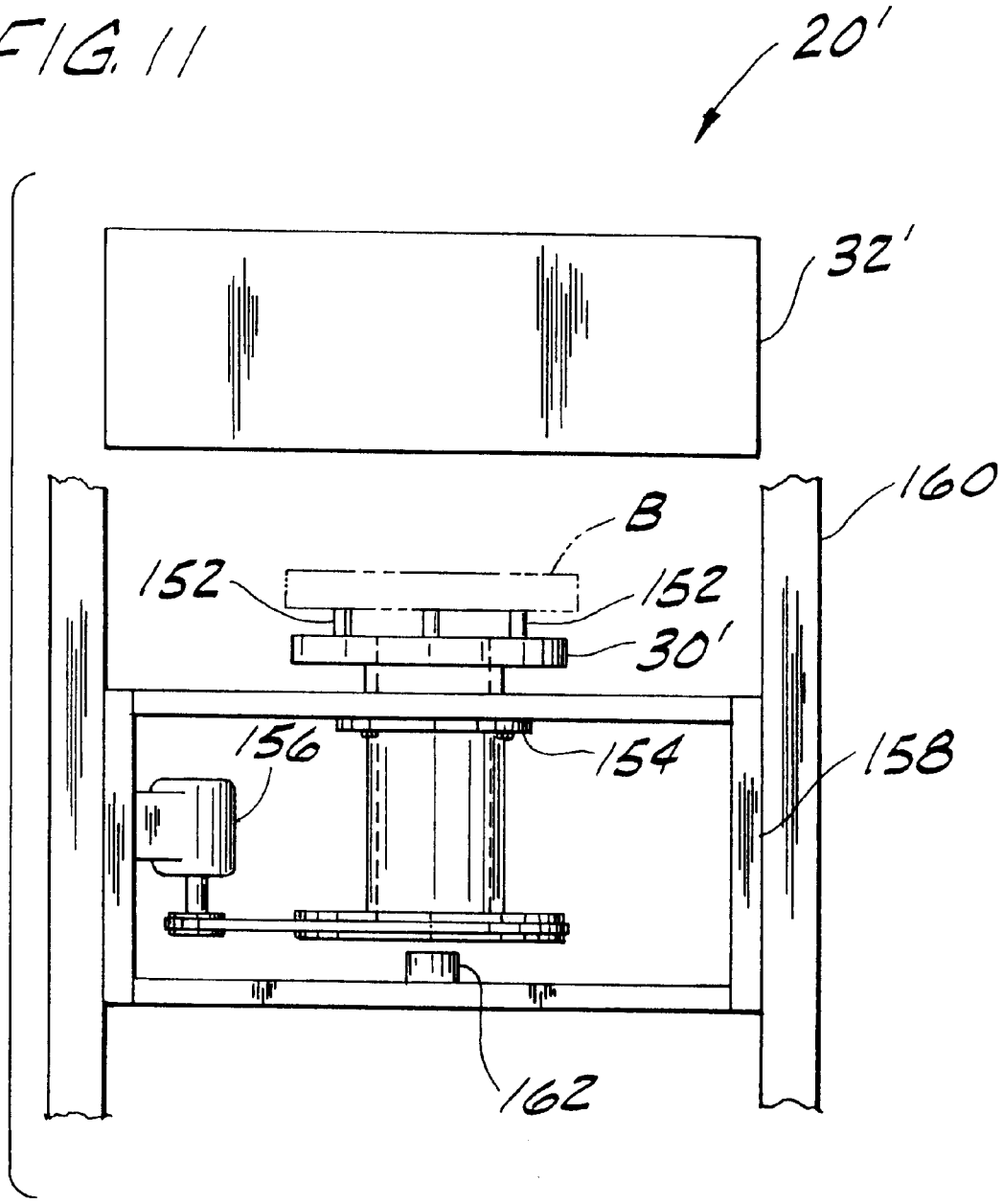
FIG. 11 is a front elevation of a polishing block heater of a second preferred embodiment of the present invention.

In a second embodiment shown in FIG. 11, the apparatus 20' includes a heater suspended above a polishing block holder 30'. The heater 32' includes an opening (not shown) facing downward toward the holder 30'. The holder 30' has three ceramic pegs 152 upon which the polishing block B sits. The pegs 152 are used to inhibit heat transfer from the block B to the holder 30'. The holder 30' is mounted on bearings 154 and is driven by a motor 156 to rotate the holder relative to a frame 158 mounted beneath the heater 32' to reduce circumferential thermal gradients around the block B. The frame 158 is mounted on vertical rails 160 which permit the frame to be raised or lowered to place the polishing block B in the vicinity of the heater 32'. The holder 30' of the second preferred embodiment is hollow so that an optical pyrometer 162 can sight the bottom of the block B to determine its temperature. In all other respects, the apparatus 20' of the second preferred embodiment is identical to the apparatus 20 of the first preferred embodiment.

FIG. 12 diagrammatically illustrates a semiconductor mounting system 170 which includes a radiant heater apparatus 20 as previously described. The system 170 also includes a bonding agent applicator 172 for applying the bonding agent to a surface of a polishing block B prior to being transported to the heater apparatus 20. After the heater apparatus 20 has sufficiently heated the bonding agent and block B, a semiconductor wafer mounting apparatus 174 is used to mount the semiconductor wafer to the polishing block B. Controllers 58*a*–58*c* control the operation of the bonding agent applicator 172, the radiant heater apparatus 20 and the mounting apparatus 174, respectively. In an alternate embodiment, a single controller may be used to control the entire system 170. For example, it is envisioned that the radiant heater 32, 32' of the present application could be incorporated into an automated wafer mounting and polishing apparatus such as described in U.S. patent application Ser. No.08/242,560 which is hereby incorporated by reference. The radiant heater 32, 32' would replace the steam pot disclosed in application Ser. No. 08/242,560.

Numerous alternate embodiments of the previously described apparatus are envisioned without departing from the scope of the present invention. For instance, it is envisioned that a transport mechanism could be added to the apparatus 20, 20' for transporting the blocks B to and from the holder 30, 30'. Further, a timer control circuit could be used in place of the pyrometer control circuit to de-energize the heater after a predetermined period of time rather than after a predetermined temperature is reached.

In view of the above, it will be seen that the several objects of the invention are achieved and other advantageous results attained. The previously described apparatus 20 heat the polishing blocks B without bringing the blocks in contact with water thereby eliminating the opportunity for the bonding agent to become pitted during heating. As a result, water-based bonding agents may be used without potentially damaging the surface of the bonding agent. Further, the blocks need not be dried when heated with the apparatus of the present invention. Thus, the drying step is eliminated from the manufacturing process.

While the present invention has been described by reference to a specific embodiment, it should be understood that modifications and variations of the invention may be constructed without departing from the scope of the invention defined in the following claims.

What is claimed is:

1. A method for mounting a semiconductor wafer on a polishing block to hold the semiconductor wafer during polishing, said method comprising the steps of:

providing a polishing block having a surface for mounting the semiconductor wafer;

coating said polishing block surface with a bonding agent;

applying radiant heat from a radiant heater in a dry environment to the polishing block and bonding agent thereon to soften said bonding agent; and applying the semiconductor wafer to the softened bonding agent.

2. A method as set forth in claim 1 wherein the step of applying radiant heat includes the step of directing the radiant heater toward a surface of the polishing block opposite the bonding agent.

3. A method as set forth in claim 2 further comprising the steps of:

sensing a temperature of the bonding agent; and terminating the application of radiant heat when the temperature reaches a predetermined limit.

4. A method as set forth in claim 3 wherein the step of applying radiant heat is terminated when the bonding agent temperature reaches about 70° C.

5. A method as set forth in claim 3 wherein the step of applying radiant heat is terminated when the bonding agent temperature reaches at least about 100° C.

6. A method as set forth in claim 1 further comprising the step of terminating the application of radiant heat after a period of less than approximately 60 seconds.

7. A method as set forth in claim 1 wherein the step of applying the radiant heat includes the step of directing the radiant heat from the radiant heater toward the polishing block surface having the bonding agent.

8. A method as set forth in claim 1 further comprising the steps of:

sensing for the presence of the polishing block; and delaying the step of applying radiant heat until the polishing block is sensed.

9. Apparatus for releasably bonding a semiconductor wafer to a polishing block to securely hold the wafer during polishing by heating the block to soften a bonding agent applied to the block, said apparatus comprising:

a polishing block holder constructed to receive and hold the polishing block; and a radiant heater mounted on the apparatus for directing radiant thermal energy toward the polishing block when received and held by the polishing block holder thereby to heat said polishing block.

10. Apparatus as set forth in claim 9 wherein said radiant heater comprises an infrared heater having infrared heater elements oriented to direct radiant thermal energy toward the polishing block holder.

11. Apparatus as set forth in claim 10 further comprising a temperature sensor for sensing the temperature of the bonding agent.

12. Apparatus as set forth in claim 11 further comprising a control connected between the sensor and the radiant heater for energizing and de-energizing the radiant heater, said control de-energizing the radiant heater when the temperature sensed by the temperature sensor reaches a predetermined temperature limit.

13. Apparatus as set forth in claim 9 further comprising a proximity sensor for sensing the presence of the polishing block when received and held by the polishing block holder.

14. Apparatus as set forth in claim 13 further comprising a control connected between the sensor and the radiant heater for energizing and de-energizing the radiant heater, said control de-energizing the radiant heater when the polishing block is absent.

15. Apparatus as set forth in claim 9 further comprising:

a fluid cooling passage for transmitting cooling fluid through said apparatus;

a cooling fluid flow sensor positioned along said passages for sensing the flow rate of the cooling fluid through the passages.

16. Apparatus as set forth in claim 15 further comprising a control connected between the sensor and the radiant heater for energizing and de-energizing the radiant heater, said control de-energizing the radiant heater when the cooling fluid flow rate sensed by the flow sensor is below a predetermined limit.

17. A semiconductor mounting system comprising:

a bonding agent applicator for applying a releasable bonding agent to a surface of a polishing block;

a radiant heater for directing radiant thermal energy toward the polishing block coated with the bonding agent to heat said polishing block and bonding agent;

a mounting apparatus for mounting a first face of a semiconductor wafer to the polishing block surface; and a controller for controlling operation of the bonding agent applicator, the radiant heater, and the mounting apparatus.

* * * * *